US007266980B1

(12) United States Patent
Ma

(10) Patent No.: US 7,266,980 B1
(45) Date of Patent: Sep. 11, 2007

(54) COMPLEX SUITCASE LOCK

(76) Inventor: Min-Tsung Ma, No. 299, Sec. 1, Park Rd., Chang Hua City, Chang Hua County 500 (TW)

( * ) Notice: Subject to any disclaimer, the term of this patent is extended or adjusted under 35 U.S.C. 154(b) by 0 days.

(21) Appl. No.: 11/583,739

(22) Filed: Oct. 20, 2006

(30) Foreign Application Priority Data

May 12, 2006 (CN) ..... 2006 2 0113833

(51) Int. Cl.
*E05B 65/52* (2006.01)
*E05B 37/02* (2006.01)

(52) U.S. Cl. ..... 70/69; 70/284; 70/312

(58) Field of Classification Search ..... 70/67–75, 70/284–285, 306, 309, 312
See application file for complete search history.

(56) References Cited

U.S. PATENT DOCUMENTS 3,961,505 A * 6/1976 Gehrie et al. ..... 70/66
4,356,712 A * 11/1982 Bako ..... 70/69
4,557,122 A * 12/1985 Hwang ..... 70/312
4,671,088 A * 6/1987 Jeang ..... 70/312
4,907,430 A * 3/1990 Hong ..... 70/312
5,943,886 A * 8/1999 Chiang ..... 70/70

* cited by examiner

*Primary Examiner*—Brian E. Glessner
*Assistant Examiner*—Alyson M. Merlino
(74) *Attorney, Agent, or Firm*—Browdy and Neimark, PLLC

(57) ABSTRACT

A complex suitcase lock includes a combination lock and a pin tumbler lock installed in a suitcase to work with two retaining units and two linking units so that the user can selectively use the combination lock or the pin tumbler lock to open the suitcase. When the pin tumbler lock is unlocked, a moveable plate is moved to a first position and disengaged from the linking units for allowing the user to push the retaining units and to further open the suitcase. When the pin tumbler lock is locked, the moveable plate is moved to a second position to hold the retaining units in engagement with hooks of the suitcase, keeping the suitcase locked.

6 Claims, 5 Drawing Sheets

COMPLEX SUITCASE LOCK

BACKGROUND OF THE INVENTION

1. Field of the Invention

The present invention relates to locks and more particularly, to a complex suitcase lock, which is a combination of a combination lock and a pin tumbler lock.

2. Description of the Related Art

Conventional suitcase locks include two types, namely, the combination lock type and the pin tumbler lock type. If a suitcase uses a combination lock, the user must rotate the numbered rotatable discs of the combination lock to show the correct combination when wanting to open the suitcase. If a suitcase uses a pin tumbler lock, the user must insert a correct key into the keyway of the pin tumbler lock and then rotate the plug of the pin tumbler lock with the key to the unlocking position when wanting to open the suitcase.

If a suitcase uses a combination lock and the user forgets the correct combination of the combination lock, the user must deliver the suitcase to the distributor or a locksmith to open the combination lock. If a suitcase uses a pin tumbler lock and the user does not have the key in hand, the user still cannot open the suitcase.

SUMMARY OF THE INVENTION

The present invention has been accomplished under the circumstances in view. It is an objective of the present invention to provide a complex suitcase lock, which is the combination of a combination lock and a pin tumbler lock and allows the user to selectively use the combination lock or the pin tumbler lock to lock/unlock the suitcase, thereby assuring high security and improving the convenience of use.

To achieve this objective of the present invention, the complex suitcase lock is installed in a suitcase, which has two hooks for locking. The complex suitcase lock comprises a housing, a lock unit, two retaining units and two links. The housing has two locating holes for receiving the hooks of the suitcase. The lock unit comprises a casing mounted in the housing, a pin tumbler lock mounted in the casing, and a combination lock mounted in the casing. The pin tumbler lock comprises a plug rotatable between a locking position and an unlocking position. The combination lock comprises a moveable plate movable between a first position and a second position, and a plurality of numbered rotatable wheels rotatable to move the moveable plate between the first position and the second position. The moveable plate is controllable by the pin tumbler lock to move between the first position and the second position. The retaining units each comprise a retaining cover respectively pivoted to the housing and provided with a hook-engaging member engageable with one of the hooks of the suitcase, a push block mounted in the retaining cover, and a spring member connected between the retaining cover and the push block. The two linking units are movably mounted in the housing, each comprising a first link having a first end stopped against the push block of one of the retaining units and a second end, a second link having a first end coupled to the second end of the first link and a second end, a third link having a first end coupled to the second end of the second link and a second end stoppable at the moveable plate of the lock unit, and a spring member supported between the first end of the first link and the housing.

When the plug of the pin tumbler lock is turned to the unlocking position, the moveable plate is moved to the first position for allowing the push blocks of the retaining units to be pushed by the user to bias the retaining covers relative to the housing and to further disengage the hook-engaging members from the hooks of the suitcase such that the suitcase is openable. When the plug of the pin tumbler lock is turned to the locking position, the moveable plate is moved to the second position and stopped against the second ends of the third links of the linking units, thereby holding the retaining covers of the retaining units in the housing and keeping the hook-engaging members of the retaining units in engagement with the hooks of the suitcase.

Therefore, by means of the arrangement of the combination lock and the pin tumbler lock, the user can selectively use the combination lock or the pin tumbler lock to unlock the suitcase, assuring high security and improving the convenience of use.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
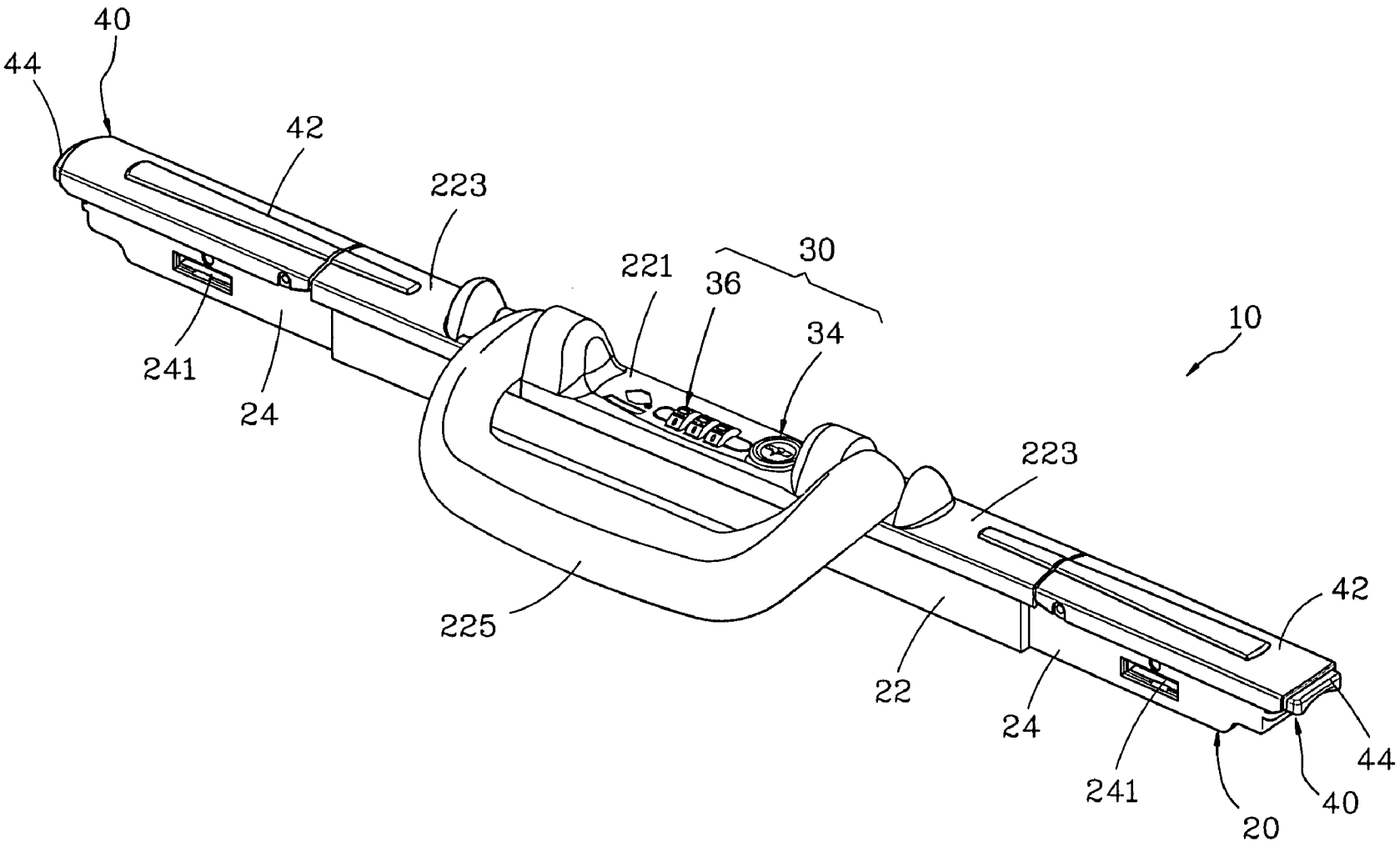
FIG. 1 is a perspective view of a complex suitcase lock according to a preferred embodiment of the present invention.
Figure 2:
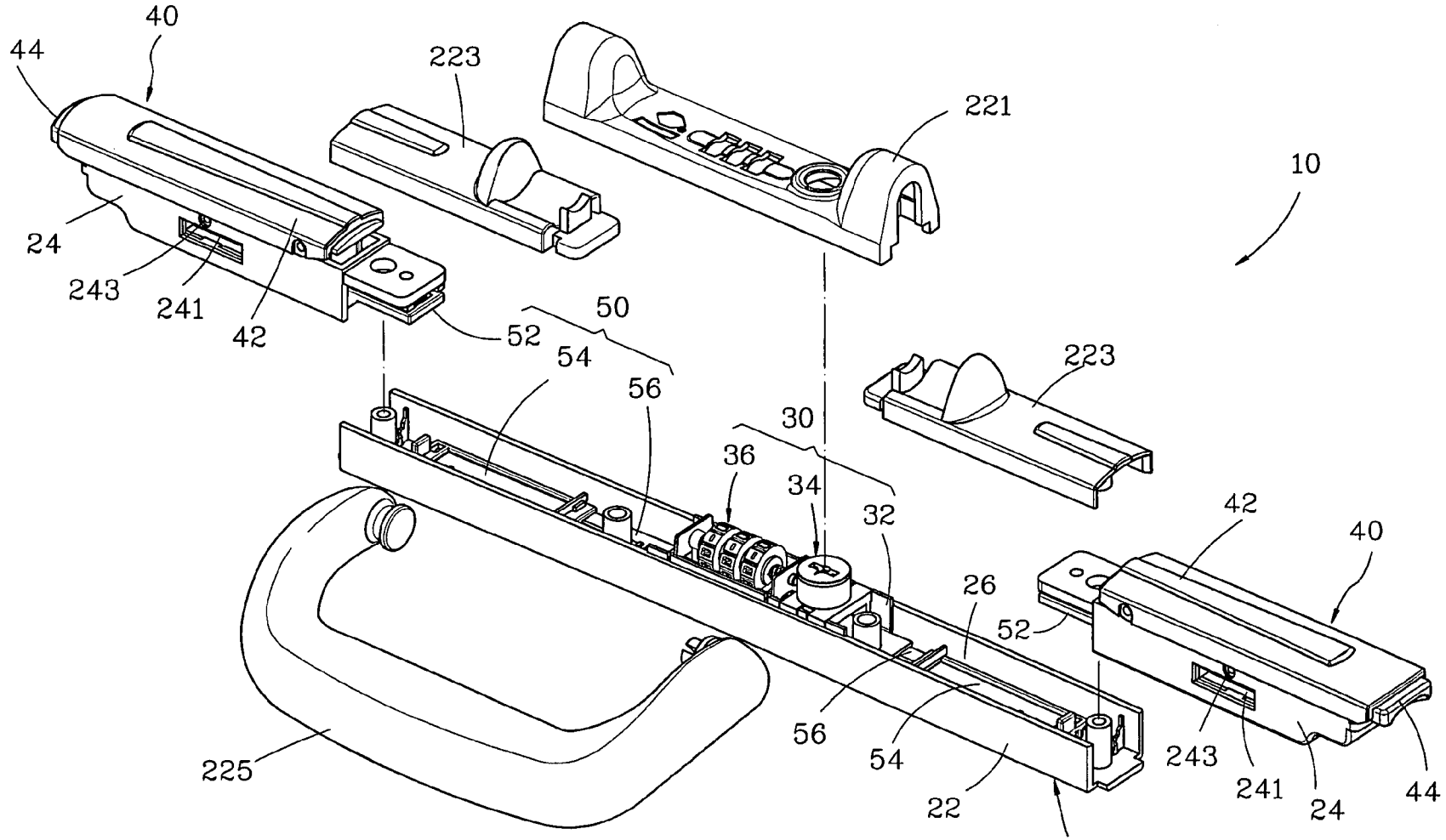
FIG. 2 is an exploded view of the complex suitcase lock according to the preferred embodiment of the present invention.

As shown in FIGS. 1 and 2, a complex suitcase lock 10 in accordance with a preferred embodiment of the present invention is adapted to be installed in a suitcase (not shown) having two hooks (not shown) and cooperated with the hooks to lock the suitcase. The complex suitcase lock 10 comprises a housing 20, a lock unit 30, two retaining units 40, and two linking units 50.

The housing 20 comprises a first hollow elongated frame bar 22, two second hollow elongated frame bars 24 respectively abutted against two distal ends of the first hollow elongated frame bar 22, a plurality of accommodation chambers 26 respectively defined in the first hollow elongated frame bar 22 and the second hollow elongated frame bars 24, a first cover shell 221 covered on the first hollow elongated frame bar 22 over the associating accommodation chamber 26 on the middle, two second cover shells 223 covered on the first hollow elongated frame bar 22 over the associating accommodation chambers respectively 26 at two sides and respectively abutted against the two distal ends of the first cover shell 221, and a carrying handle 225 pivoted to the first cover shell 221. The two second hollow elongated frame bars 24 each have a locating hole 241 in each of two opposite lateral sidewalls thereof for respectively receiving the hooks of the suitcase, a locating rod 243 disposed above the locating holes 241, a hook-engaging portion 245 at one end (see FIG. 6), and a locating plate 247 set in the associating accommodation chamber 26 (see FIG. 4).

Figure 3:
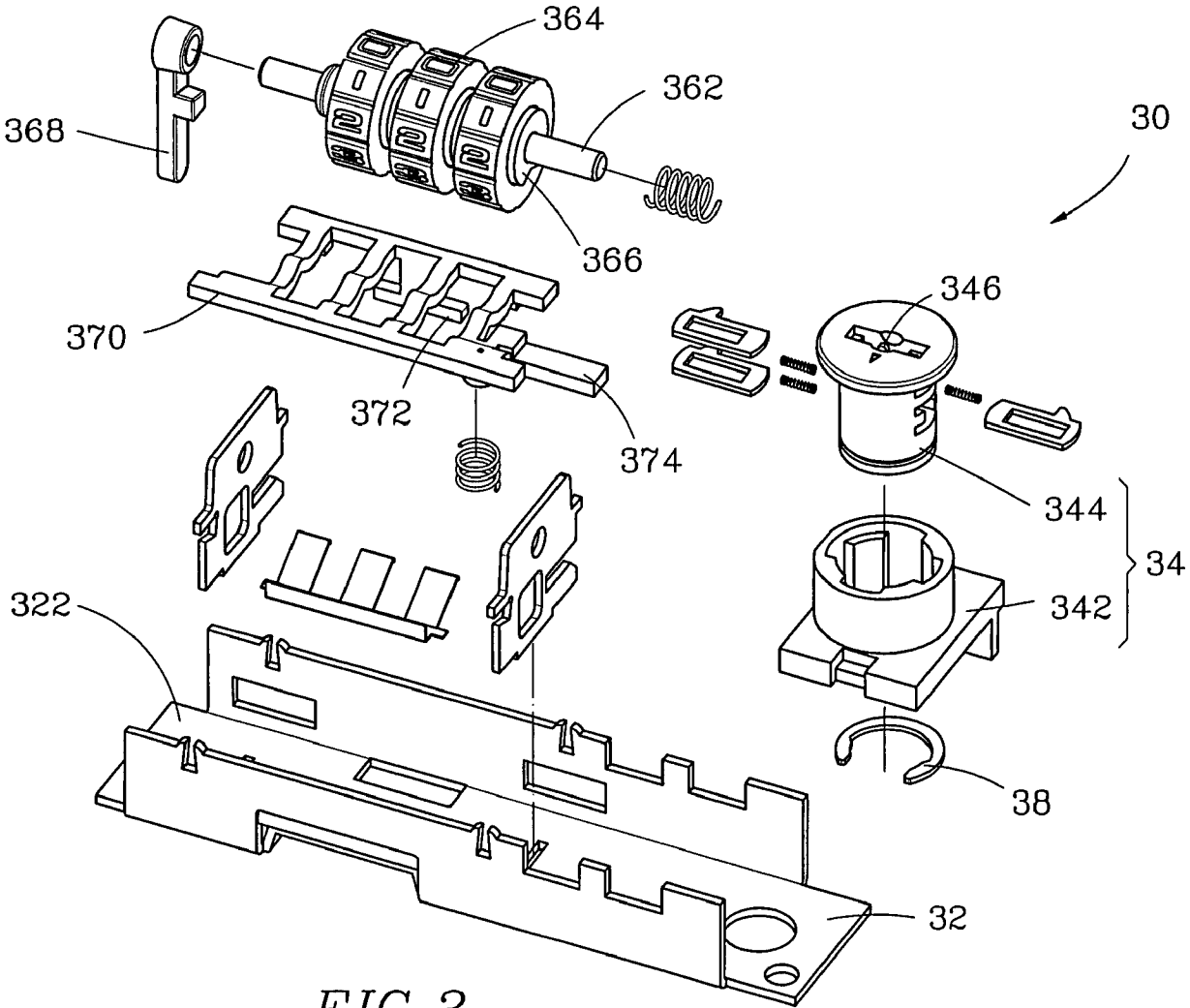
FIG. 3 is an exploded view of the lock unit of the complex suitcase lock according to the preferred embodiment of the present invention.

Referring to FIG. 3, the lock unit 30 includes a casing 32, a pin tumbler lock 34, and a combination lock 36. The casing 32 is mounted in the accommodation chamber 26 of the first hollow elongated frame bar 22, defining a receiving chamber 322. The pin tumbler lock 34 comprises a plug holder 342 fixedly mounted in the receiving chamber 322 of the casing 32, and a plug 344 inserted through the plug holder 342 and secured thereto by a C-shaped retainer 38. The plug 344 can be rotated by a key (not shown) relative to the plug holder 342 between a locking position and an unlocking position. The plug 344 has a keyway 346 in the top side for the insertion of the key, and a bottom plugpin 348, which has a beveled edge 349 (see FIG. 5).

The combination lock 36 is mounted in the receiving chamber 322 of the casing 32. The combination lock 36 includes a shaft 362, three notched numbered rotatable discs 364 mounted on the shaft 362, three cams 366 mounted on the shaft 362 and abutted to the notched numbered rotatable discs 364 respectively, a lever 368 coupled to the shaft 362 for setting/changing the number combination of the combination lock 36, and a moveable plate 370 adapted to support the notched numbered rotatable discs 364 and the cams 366. The moveable plate 370 has a downwardly extending bottom protrusion 372 inserted through the bottom side of the casing 32, and a stop rod 374 horizontally extending from one end thereof toward the pin tumbler lock 34 and abutted against the plugpin 348 of the plug 344 of the pin tumbler lock 34. Rotating the notched numbered rotatable discs 364 will cause a vertical movement of the moveable plate 370 relative to the notched numbered rotatable discs 364 between a first position and a second position. When the notched numbered rotatable discs 364 are rotated to a correct combination, the moveable plate 370 is moved to the first position, and the combination lock 36 is unlocked. When the moveable plate 370 is moved to the second position, the combination lock 36 is locked. When the pin tumbler lock 34 is locked, the plugpin 348 is stopped against the stop rod 374. When inserting the key into the keyway 346 to rotate and open the pin tumbler lock 34, the stop rod 374 is forced by the beveled bottom edge 349 of the plugpin 348 to lower the moveable plate 370 from the second position to the first position.

Figure 4:
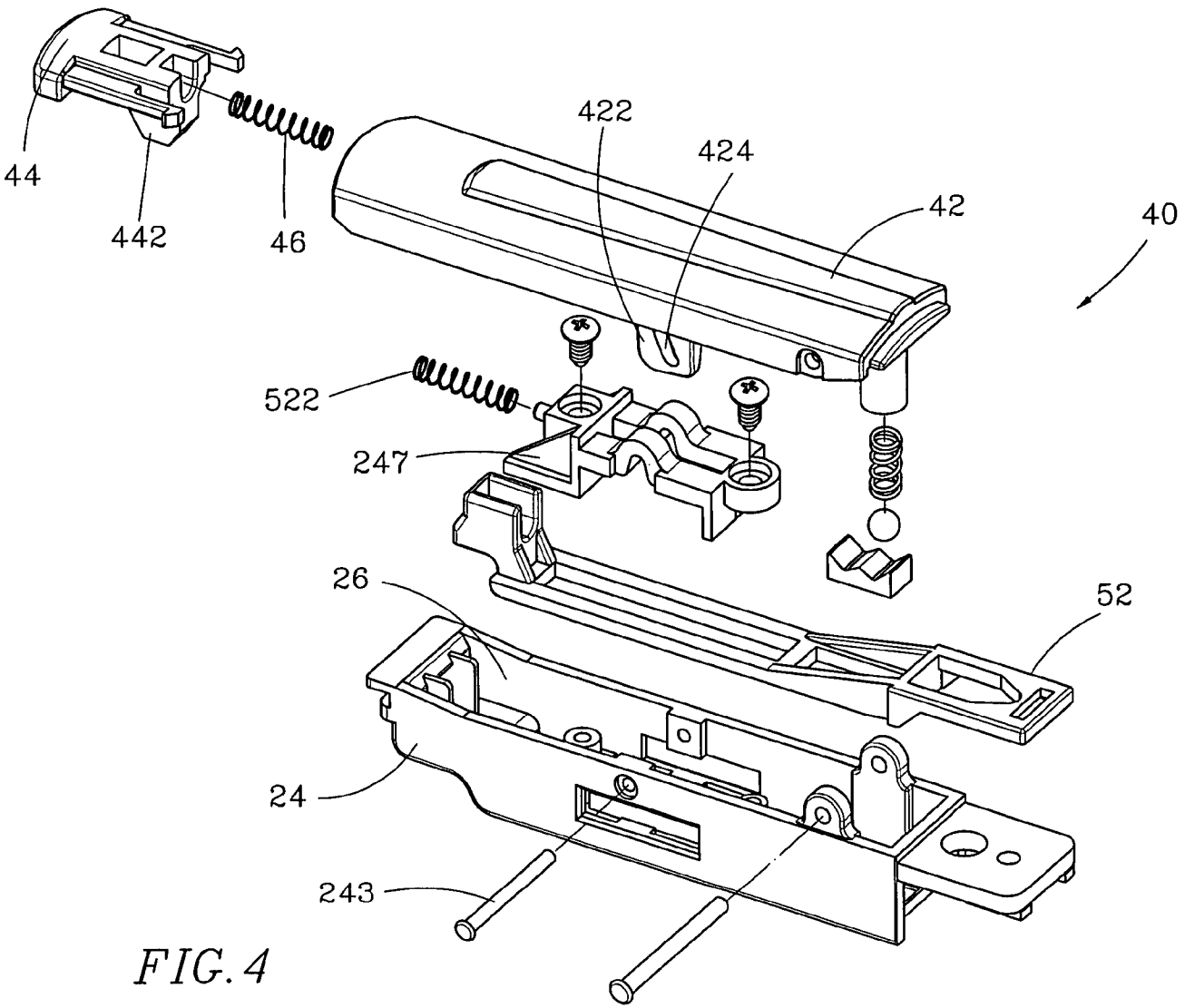
FIG. 4 is an exploded view of one retaining unit of the complex suitcase lock according to the preferred embodiment of the present invention.

Referring to FIG. 4, the retaining units 40 each are comprised of a retaining cover 42, a push block 44, and a spring member 46. The retaining covers 42 of the retaining units 40 are respectively pivoted to the second hollow elongated frame bars 24. Each of the retaining covers 42 has a downwardly extending hook-engaging member 422 in which a sliding slot 424 is formed. The locating rods 243 of the second hollow elongated frame bars 24 are respectively inserted through the sliding slots 424 of the retaining covers 42 of the retaining units 40. The push blocks 44 of the retaining units 40 each have a hook 442 respectively hooked in the hook-engaging portions 245 of the second hollow elongated frame bars 24. The spring member 46 is stopped between the associating retaining cover 42 and the associating push block 44.

Figure 5:
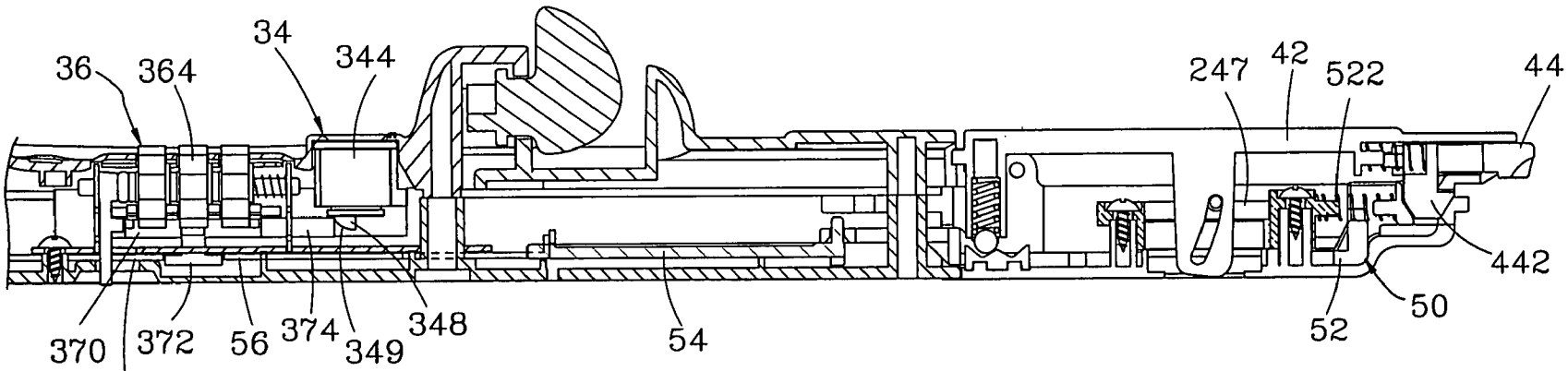
FIG. 5 is a sectional view of a part of the preferred embodiment of the present invention, showing that the moveable plate is in the second position and the retaining unit is received in the housing.

Referring to FIG. 5, the linking units 50 are respectively mounted in the accommodation chambers 26 of the first and second hollow elongated frame bars 22, 24. Each of the linking unit 50 includes a first link 52, a spring member 522, a second link 54, and a third link 56. The first link 52 has a rear end stoppable at the hook 442 of the push block 44 of one retaining unit 40, and a front end coupled to the second link 54. The second link 54 has a front end coupled to the third link 56, and a rear end coupled to the front end of the first link 52, so that the coupled first, second and third links 52, 54 and 56 are horizontally and reciprocally moveable in the accommodation chambers 26. The third link 56 has a front end stopped at the bottom protrusion 372 of the moveable plate 370, and a rear end coupled to the front end of the second link 54. The spring member 522 is connected between the first link 52 and the associating second hollow elongated frame bar 24 (see FIG. 4). When pushing the push blocks 44 of the retaining units 40, the first links 52 of the linking units 50 are forced to push the associating second links 54 and then the associating third links 56.

When the user wants to open the suitcase by means of the combination lock 36, the user must rotate the notched numbered rotatable discs 364 to show the correct combination so as to further move the moveable plate 370 to the first position. When the moveable plate 370 is moved to the first position, the combination lock 36 is unlocked. When the combination lock 36 is unlocked, the user can push the push blocks 44 to move the linking units 50, thereby biasing the retaining covers 42 of the associating retaining units 40 upwards to disengage the hooks 442 of the push blocks 44 from the associating hook-engaging portions 245 and disengage the hooks of the suitcase from the hook-engaging member 422. Thus, the user can open the suitcase. When the user rotating the notched numbered rotatable discs 364 to lock the combination lock 36, as shown in FIG. 5, the moveable plate 370 will be lifted to the second position. When the moveable plate 370 is moved to the second position, the front end of the third link 56 is stopped by the bottom protrusion 372 of the moveable plate 370 at the same elevation. At this time, pushing the push blocks 44 does not cause movement of the linking units 50, and the retaining covers 42 of the two retaining units 40 are respectively maintained secured to the associating second hollow elongated frame bars 24, and therefore the suitcase is not openable.

Figure 6:
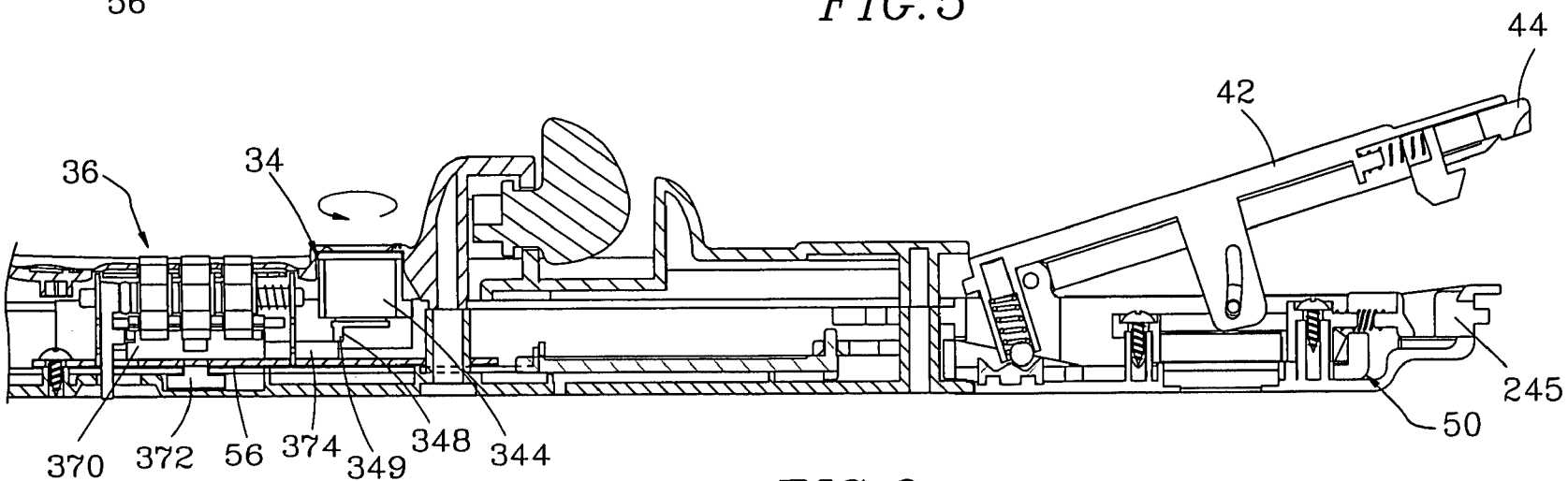
FIG. 6 is a sectional view of a part of the preferred embodiment of the present invention, showing that the moveable plate is in the first position and the retaining unit is turned out of the housing.

Referring to FIG. 6, if the user cannot remember the correct combination of the combination lock 36, the key can be inserted into the keyway 346 of the pin tumbler lock 34 and rotated to lower the moveable plate 370 to the first position. At this time, the beveled bottom edge 349 of the plugpin 348 of the plug 344 is forced against the stop rod 374 of the moveable plate 370 to lower the moveable plate 370 to the first position and to further disengage the bottom protrusion 372 of the moveable plate 370 from the third links 56 of the lining units 50, for enabling the user to push the push blocks 44 and to further bias the retaining covers 42 of the associating retaining units 40 upwards so as to disengage the hooks 442 of the push blocks 44 from the associating hook-engaging portions 245. Thus, the suitcase is opened.

By means of the arrangement of the combination lock 36 and the pin tumbler lock 34, the user can selectively use the combination lock 36 or the pin tumbler lock 34 to unlock the suitcase, assuring high security and improving the convenience of use.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A complex suitcase lock installed in a suitcase having two hooks, the complex suitcase lock comprising:

a housing having two locating holes for receiving the hooks of the suitcase;

a lock unit including a casing mounted in the housing, a pin tumbler lock mounted in the casing, and a combination lock mounted in the casing;

wherein the pin tumbler lock includes a plug rotatable between a locking position and an unlocking position;

wherein the combination lock includes a plurality of numbered rotatable wheels and a moveable plate movable between a first position and a second position by the control of the numbered rotatable wheels or the plug selectively;

two retaining units each including a retaining cover pivoted to the housing and provided with a hook-engaging member engageable with one of the hooks of the suitcase, a push block movably mounted in the retaining cover, and a spring member connected between the retaining cover and the push block; and two linking units movably mounted in the housing, said linking units each including a first link having a first end stopped against the push block of one of the retaining units and a second end, a second link a first end coupled to the second end of the first link and a second end, a third link having a first end coupled to the second end of the second link and a second end stoppable at the moveable plate of the lock unit, and a spring member supported between the first end of the first link and the housing;

wherein when the plug of the pin tumbler lock is turned to the unlocking position, the moveable plate is moved to the first position for allowing the push blocks of the retaining units to be pushed by the user to bias the retaining covers relative to the housing and to further disengage the hook-engaging members from the hooks of the suitcase such that the suitcase is openable; when the plug of the pin tumbler lock is turned to the locking position, the moveable plate is moved to the second position and stopped against the second ends of the third links of the linking units, thereby holding the retaining covers of the retaining units in the housing and keeping the hook-engaging members of the retaining units in engagement with the hooks of said suitcase.

2. The complex suitcase lock as claimed in claim 1, wherein said plug of said pin tumbler lock has a plugpin; said moveable plate has a stop rod movable by said plugpin of said plug of said pin tumbler lock to move said moveable plate between said first position and said second position.

3. The complex suitcase lock as claimed in claim 2, wherein said plugpin has a beveled bottom edge stopped at the stop rod of said moveable plate for moving said moveable plate between said first position and said second position when said plug of said pin tumbler lock is rotated between the locking position and the unlocking position.

4. The complex suitcase lock as claimed in claim 1, wherein said moveable plate has a bottom protrusion, said bottom protrusion being disengaged from the third links of said linking units for allowing the user to push the push blocks of said linking units when said moveable plate is moved to said first position, said bottom protrusion being stopped against the third links of said linking units to prohibit movement of said linking units when said moveable plate is moved to said second position.

5. The complex suitcase lock as claimed in claim 4, wherein said housing has two hook-engaging portions; the push blocks of said retaining units each have a hook respectively hooked in the hook-engaging portions of said housing, the push blocks of said retaining units being moveable to disengage the hooks from the hook-engaging portions of said housing when said moveable plate is moved to said second position.

6. The complex suitcase lock as claimed in claim 1, wherein said housing has a locating plate and the spring member of the linking unit is stopped between the first link and the locating plate.

* * * * *